US011874072B2

(12) United States Patent
Kubo et al.

(10) Patent No.: US 11,874,072 B2
(45) Date of Patent: Jan. 16, 2024

(54) LAMINATED FLUID WARMER

(71) Applicant: KABUSHIKI KAISHA KOBE SEIKO SHO (KOBE STEEL, LTD.), Hyogo (JP)

(72) Inventors: Yohei Kubo, Kobe (JP); Koji Noishiki, Takasago (JP); Yasutake Miwa, Takasago (JP); Masataka Azuma, Takasago (JP)

(73) Assignee: Kobe Steel, Ltd., Hyogo (JP)

( * ) Notice: Subject to any disclaimer, the term of this patent is extended or adjusted under 35 U.S.C. 154(b) by 29 days.

(21) Appl. No.: 17/456,498

(22) Filed: Nov. 24, 2021

(65) Prior Publication Data

US 2022/0205730 A1 Jun. 30, 2022

(30) Foreign Application Priority Data

Dec. 28, 2020 (JP) ..... 2020-218727

(51) Int. Cl.
*F28D 9/00* (2006.01)
*F28F 9/02* (2006.01)

(52) U.S. Cl.
CPC ..... *F28D 9/0062* (2013.01); *F28F 9/0221* (2013.01); *F28F 9/0265* (2013.01); *F28F 2265/06* (2013.01); *F28F 2265/14* (2013.01)

(58) Field of Classification Search
CPC ... F28D 9/0062; F28F 9/02212; F28F 9/0265; F28F 2265/06; F28F 2265/14; F22B 37/50
See application file for complete search history.

(56) References Cited

U.S. PATENT DOCUMENTS

2014/0076518 A1* 3/2014 Edwards ..... F28D 1/0475 165/71
2016/0363384 A1* 12/2016 Whitney ..... F28D 7/024
2017/0299269 A1* 10/2017 Ausman ..... F28F 9/0231
2019/0368830 A1* 12/2019 Jahnke ..... F28F 17/00
2020/0049411 A1* 2/2020 Takahashi ..... F28F 1/105
2020/0182550 A1* 6/2020 Army ..... F28F 9/26

FOREIGN PATENT DOCUMENTS

EP 3 220 088 A1 9/2017
JP 2004513320 A * 4/2004
JP 2005-134066 A 5/2005
JP 2006057867 A * 3/2006 ..... F28C 1/14
WO WO-2020212091 A1 * 10/2020 ..... F28B 1/06

OTHER PUBLICATIONS

The extended European search report issued by the European Patent Office dated Mar. 31, 2022, which corresponds to European Patent Application No. 21208136.8-1002 and is related to U.S. Appl. No. 17/456,498.

* cited by examiner

*Primary Examiner* — Devon Russell
(74) *Attorney, Agent, or Firm* — Studebaker & Brackett PC

(57) ABSTRACT

A laminated fluid warmer includes: a laminate including a target fluid layer having a plurality of target fluid channels through which a warming target fluid flows, and a warming fluid layer that is laminated on the target fluid layer and has a plurality of warming fluid channels through which a warming fluid for warming the target fluid layer flows; and a collection device that collects at least a part of the warming fluid accumulated in the plurality of warming fluid channels. The collection device includes a storage portion that receives the warming fluid flowing out from the warming fluid channel when collecting the warming fluid.

7 Claims, 5 Drawing Sheets

LAMINATED FLUID WARMER

FIELD OF THE INVENTION

The present invention relates to a laminated fluid warmer.

BACKGROUND ART

Conventionally, as disclosed in Japanese Patent No. 6118008, there has been known a laminated fluid warmer including a first flow path layer through which a warming target fluid such as a low-temperature liquefied gas flows and a second flow path layer through which a warming fluid such as an antifreeze liquid flows, the first flow path layer and the second flow path layer being laminated. In the laminated fluid warmer disclosed in Japanese Patent No. 6118008, an adjustment layer having low heat transfer performance is provided between the first flow path layer and the second flow path layer at a place where a warming fluid tends to have a relatively low temperature. By providing the adjustment layer, the warming fluid is suppressed from being frozen.

In the technique disclosed in Japanese Patent No. 6118008, the adjustment layer having low heat transfer performance is provided between the first flow path layer and the second flow path layer to locally suppress heat transfer between the warming fluid and the warming target fluid, thereby suppressing the warming fluid from being frozen. This technique may suppress freezing of a warming fluid in a normal state in which a warming target fluid flows through the first flow path layer and the warming fluid flows through the second flow path layer. However, when a flow of the warming fluid is stopped as in emergency stop or the like, there occurs a problem that the warming fluid will freeze sooner or later even if heat transfer between the warming fluid and the warming target fluid is suppressed.

SUMMARY OF THE INVENTION

An object of the present invention is to suppress a warming fluid from being frozen even when the warming fluid is stopped flowing.

A laminated fluid warmer according to the present invention includes: a laminate including a target fluid layer having a plurality of target fluid channels for flowing a warming target fluid, and a warming fluid layer that is laminated on the target fluid layer and has a plurality of warming fluid channels for flowing a warming fluid for warming the target fluid layer; and a collection device for collecting at least a part of the warming fluid accumulated in the plurality of warming fluid channels.

DESCRIPTION OF EMBODIMENTS

Hereinafter, embodiments of the present invention will be described in detail with reference to the drawings.

First Embodiment

Figure 1:
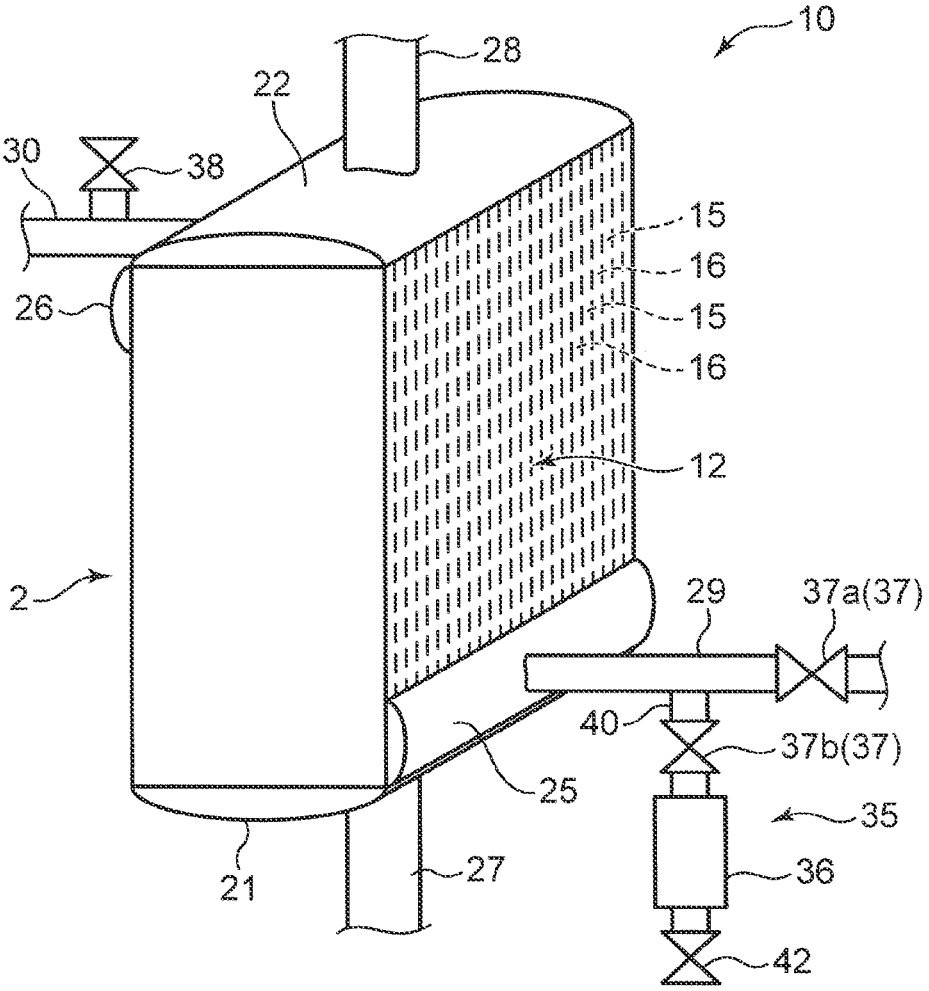
FIG. 1 is a perspective view of a laminated fluid warmer according to a first embodiment.

As illustrated in FIG. 1, a laminated fluid warmer 10 according to a first embodiment is a warmer for warming a warming target fluid with heat of a warming fluid, and includes a laminate 12 for performing heat exchange between the warming fluid and the warming target fluid.

Figure 2:
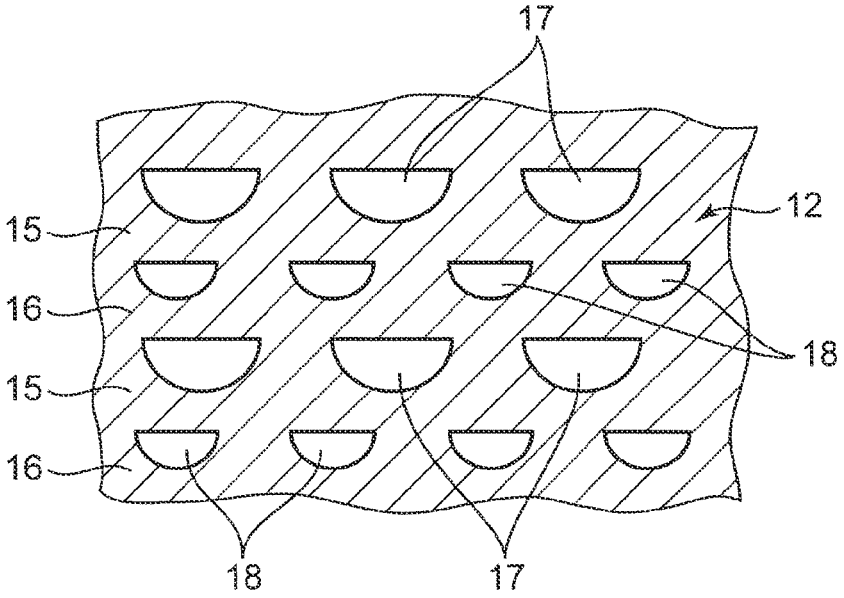
FIG. 2 is an enlarged view illustrating a partial cross-sectional configuration of a laminate of the laminated fluid warmer.

As illustrated in FIG. 2, the laminate 12 includes a plurality of target fluid layers 15 and a plurality of warming fluid layers 16 and has a structure in which the target fluid layers 15 and the warming fluid layers 16 are alternately laminated. Another layer (not illustrated) for exerting a predetermined function may be provided between some of the target fluid layers 15 and the warming fluid layers 16.

Each target fluid layer 15 has a plurality of target fluid channels 17, and the warming target fluid flows through each target fluid channel 17. Examples of the warming target fluid include liquefied gases such as liquefied natural gas (LNG), liquefied ammonia, liquefied carbon dioxide, liquefied nitrogen, and liquefied hydrogen.

Each warming fluid layer 16 has a plurality of warming fluid channels 18, and the warming fluid flows through each warming fluid channel 18. Examples of the warming fluid include liquids such as antifreeze liquid (ethylene glycol aqueous solution) and hot water.

The laminate 12 is obtained by stacking a plurality of metal plates having a plurality of grooves formed on one surface thereof and diffusion-bonding the plurality of metal plates. Thus, the laminate 12 includes the target fluid layer 15 formed of a first metal plate having a plurality of grooves formed on one surface thereof and the warming fluid layer 16 formed of a second metal plate having a plurality of grooves formed on one surface thereof. The plurality of target fluid channels 17 is formed by superimposing the second metal plate on the plurality of grooves formed in the first metal plate, and the plurality of warming fluid channels 18 is formed by superimposing the first metal plate on the plurality of grooves formed in the second metal plate. As illustrated in FIG. 1, each of the target fluid layer 15 and the warming fluid layer 16 is disposed to have an attitude extending in an up-down direction. However, the configuration of the laminate 12 is not limited to the configuration in which the layers are disposed to have this attitude.

Since diffusion-bonding of the first metal plate and the second metal plate prevents a boundary therebetween from appearing, the boundary between the target fluid layer 15 and the warming fluid layer 16 is not visually seen. In FIG. 1, the boundary is indicated by a broken line for the sake of convenience so that the laminating direction of the target fluid layers 15 and the warming fluid layers 16 can be seen. However, the bonding between the first metal plate and the second metal plate is not limited to diffusion-bonding.

Each target fluid channel 17 opens on a lower surface and an upper surface of the laminate 12, and extends linearly in the up-down direction between the lower surface and the upper surface, or extends in the up-down direction while meandering from side to side between the lower surface and the upper surface. An opening on the lower surface serves as an inlet of the target fluid channel 17, and an opening on the upper surface serves as an outlet of the target fluid channel 17.

Each of the warming fluid channels 18 opens in a lower portion of one side surface (a right side surface in FIG. 1) and in an upper portion of an opposite side surface (a left side surface in FIG. 1) in the laminate 12. An opening formed in the lower portion of the one side surface serves as an inlet of the warming fluid, and an opening formed in the upper portion of the other side surface serves as an outlet of the warming fluid. In other words, the inlet of the warming fluid is disposed at a height position lower than the outlet. Each warming fluid channel 18 may extend in the up-down direction while meandering from side to side between the inlet and the outlet, or may extend linearly in the up-down direction. However, the positional relationship between the inlet and the outlet may be reversed.

As illustrated in FIG. 1, a distribution header 21 and a mass header 22 communicating with the target fluid channel 17 and an inflow header 25 and an outflow header 26 communicating with the warming fluid channel 18 are coupled to the laminate 12.

The distribution header 21 is a header for distributing the warming target fluid to the plurality of target fluid channels 17, and is provided so as to cover the inlets of the plurality of target fluid channels 17. An introduction pipe 27 for the warming target fluid is connected to the distribution header 21.

The mass header 22 is a header for massing the warming target fluid flowing through the plurality of target fluid channels 17, and is provided so as to cover the outlets of the plurality of target fluid channels 17. A discharge pipe 28 is connected to the mass header 22.

The inflow header 25 is a header for distributing the warming fluid to the plurality of warming fluid channels 18, and is provided on the side surface of the laminate 12 so as to cover the inlets of the plurality of warming fluid channels 18. The inflow header 25 extends horizontally along a lower edge of the laminate 12. An inflow pipe 29 for a warming fluid is connected to the inflow header 25.

The outflow header 26 is a header for massing the warming fluid flowing through the plurality of warming fluid channels 18, and is provided on the side surface of the laminate 12 so as to cover the outlets of the plurality of warming fluid channels 18. The outflow header 26 extends horizontally along an upper edge of the laminate 12. An outflow pipe 30 is connected to the outflow header 26.

The warming target fluid is a fluid having a temperature lower than a freezing point of the warming fluid. Therefore, in a case where the flow of the warming fluid in the warming fluid channel 18 is stopped, the warming fluid might freeze in the warming fluid channel 18 and might block the warming fluid channel 18. Therefore, the laminated fluid warmer 10 of the present embodiment is provided with a collection device 35 for collecting the warming fluid from the warming fluid channel 18.

The collection device 35 includes a storage portion 36 for storing the warming fluid, a switching mechanism 37 for switching the flow of the warming fluid, and an opening and closing mechanism 38.

The switching mechanism 37 includes a mainstream valve 37*a* provided at the inflow pipe 29 so as to open and close the inflow pipe 29, and a branch valve 37*b* provided so as to branch from the inflow pipe 29. The mainstream valve 37*a* is disposed at a position farther from the inflow header 25 than the branch position of the inflow pipe 29 into the branch valve 37*b*. The branch valve 37*b* is provided at the branch pipe 40 that branches downward from a bottom portion of the inflow pipe 29 extending horizontally from the inflow header 25. The storage portion 36 is disposed below the branch valve 37*b* via the branch pipe 40. In other words, the storage portion 36 is connected to the inflow pipe 29. A vent valve 42 which is opened when the warming fluid is discharged to the outside is provided below the storage portion 36. The branch valve 37*b* may be directly connected to a lower surface of the inflow pipe 29 instead of being provided at the branch pipe 40. Even in this case, the branch valve 37*b* is provided so as to branch from the inflow pipe 29.

Although in the illustrated example, the switching mechanism 37 includes the mainstream valve 37*a* and the branch valve 37*b*, the present embodiment is not limited thereto. The switching mechanism 37 may be configured by a three way valve (not illustrated) disposed at a connection portion between the inflow pipe 29 and the branch pipe 40.

The opening and closing mechanism 38 is provided to open the warming fluid channel 18 to the atmosphere so that the warming fluid in the warming fluid channel 18 flows down by gravity at the collection of the warming fluid. The opening and closing mechanism 38 is formed of an on-off valve and is configured to be switchable between a state in which the warming fluid channel 18 is opened to the atmosphere and a state in which the warming fluid channel is blocked from the atmosphere. The opening and closing mechanism 38 is closed during normal operation and is opened when the warming fluid is collected.

During the normal operation in which the warming target fluid is heated by the heat of the warming fluid to vaporize, the mainstream valve 37*a* is opened and the branch valve 37*b* is closed, and the opening and closing mechanism 38 is closed. In this state, the warming fluid flows through the inflow pipe 29 toward the inflow header 25. The warming fluid flows from the inflow header 25 into each warming fluid channel 18. On the other hand, the warming target fluid flows through the introduction pipe 27 toward the distribution header 21. The warming target fluid flows from the distribution header 21 into each target fluid channel 17.

In the laminate 12, heat exchange is performed between the warming fluid flowing in the warming fluid channel 18 and the warming target fluid flowing in the target fluid channel 17, so that the warming target fluid is warmed and vaporized. The warming fluids flowing in the respective warming fluid channels 18 merge in the outflow header 26 and flow through the outflow pipe 30. On the other hand, the warming target fluids flowing in the target fluid channels 17 merge in the mass header 22 and flow through the discharge pipe 28.

In a case where the flow of the warming target fluid and the warming fluid is stopped for some reason or other while the laminated fluid warmer 10 is performing the normal operation, the mainstream valve 37*a* is closed and the branch valve 37*b* is opened for removing the warming fluid from the inside of the warming fluid channel 18. At this time, the opening and closing mechanism 38 is opened.

In this state, since the flow of the warming fluid from the inflow pipe 29 toward the inflow header 25 is stopped, the warming fluid in the warming fluid channel 18 flows in a lower direction. In other words, the warming fluid flows by gravity. As a result, the warming fluid in the warming fluid channel 18 flows into the inflow pipe 29 from the warming fluid channel 18 through the inflow header 25. The warming fluid flowing into the inflow pipe 29 flows into the storage portion 36 through the branch valve 37*b*. As a result, the state in which the inside of the warming fluid channel 18 is filled with the warming fluid is eliminated. It is accordingly possible to prevent the warming fluid in the warming fluid channel 18 from being cooled and frozen by the warming target fluid.

Figure 3A:
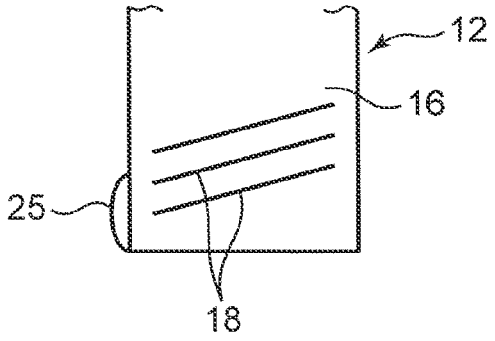
FIG. 3A and FIG. 3B are diagrams for explaining a shape of a warming fluid channel.
Figure 3B:
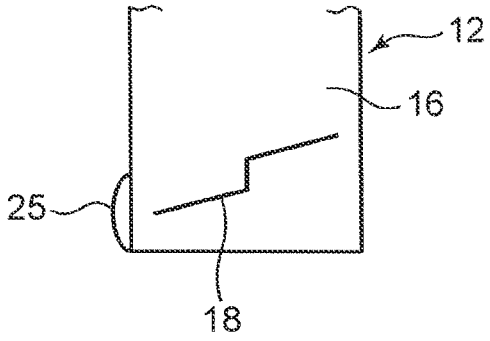

In a case of a configuration in which the warming fluid flows from the warming fluid channel 18 by gravity, the warming fluid channel 18 may have a shape linearly extending in an inclined shape gradually descending from the outlet toward the inlet as illustrated in FIG. 3A, or may have a shape (serpentine shape) in which a middle portion descends while being bent as illustrated in FIG. 3B.

As described above, in the present embodiment, the collection device 35 collects at least a part of the warming fluid accumulated in the plurality of warming fluid channels 18 of the warming fluid layer 16. Therefore, since it is possible to prevent a state where the warming fluid is accumulated in the warming fluid channel 18 from being maintained, it is possible to prevent the warming fluid from being cooled more than necessary by the warming target fluid even in a state where the flow of the warming fluid is stopped. Therefore, it is possible to prevent the warming fluid from freezing in the warming fluid channel 18. In particular, in a case of a small-diameter channel such as the warming fluid channel 18 formed in the warming fluid layer 16, the warming fluid might freeze early when the warming fluid does not flow in the warming fluid channel 18. However, since the warming fluid in the warming fluid channel 18 is collected by the collection device 35, it is possible to avoid freezing of the warming fluid in the warming fluid channel 18.

In the present embodiment, since the warming fluid in the warming fluid channel 18 located above the inflow pipe 29 can be collected, more warming fluid can be collected through the inflow pipe 29.

In the present embodiment, the warming fluid in the warming fluid channel 18 flows by gravity and flows out from the warming fluid channel 18. Therefore, the warming fluid in the warming fluid channel 18 can be collected without providing a pressurizing unit for pushing out the warming fluid in the warming fluid channel 18 and a suction portion for sucking the warming fluid in the warming fluid channel 18.

Figure 4:
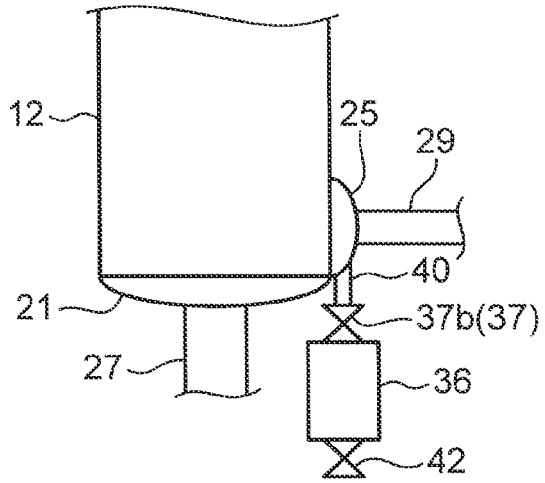
FIG. 4 is a schematic view illustrating a modification of a configuration in which a storage portion is connected to an inflow header.

Although in the first embodiment, the configuration in which the storage portion 36 is connected to the inflow pipe 29 has been shown, the storage portion 36 may be connected to the inflow header 25 as illustrated in FIG. 4. Specifically, the branch pipe 40 is connected to a bottom portion of the inflow header 25 and extends downward from the inflow header 25. The branch pipe 40 is provided with the storage portion 36.

The inflow header 25 has a shape long in a horizontal direction, and the branch pipe 40 is connected to the inflow header 25 at a position below a connection portion of the inflow pipe 29 with the inflow header 25. The position where the branch pipe 40 is connected to the inflow header 25, that is, the position where the branch pipe 40 is opened in the inflow header 25 may be located below all the warming fluid channels 18. In this case, when the branch valve 37*b* is opened, the warming fluid in all the warming fluid channels 18 flows into the branch pipe 40, i.e., the storage portion 36.

Although in the first embodiment, it is assumed that the inflow header 25 has a shape extending in the horizontal direction, the present embodiment is not limited thereto. The inflow header 25 may have a shape long in a vertical direction, for example. In this case, since the connection portion of the inflow pipe 29 with the inflow header 25 is located at an intermediate portion in a longitudinal direction of the inflow header 25, the bottom portion of the inflow header 25 is likely to be located below the connection portion of the inflow pipe 29. Therefore, as compared with the configuration in which the branch pipe 40 branches from the inflow pipe 29, the connection position of the branch pipe 40 with the inflow header 25 can be positioned downward.

Although the first embodiment adopts the configuration in which the storage portion 36 is provided at the branch pipe 40 connected to the inflow pipe 29 or the inflow header 25, the present embodiment is not limited to this configuration. For example, the storage portion 36 may be omitted, and the branch pipe 40 without the storage portion 36 may be connected to the inflow pipe 29 or the inflow header 25. In this case, the branch pipe 40 functions as a reception pipe that receives the warming fluid flowing out from the warming fluid channel 18 at the time of collection of the warming fluid from the warming fluid channel 18.

Although the first embodiment adopts the configuration in which the branch valve 37*b* is provided at the branch pipe 40 connected to the inflow pipe 29 or the inflow header 25, the present embodiment is not limited to this configuration. For example, the branch valve 37*b* may be connected directly to the inflow pipe 29 or the inflow header 25.

Although the first embodiment adopts the configuration in which the storage portion 36 and the branch pipe 40 are disposed on the inflow side of the warming fluid with respect to the laminate 12, alternatively, the storage portion and the branch pipe may be disposed on the outflow side of the warming fluid with respect to the laminate 12. In other words, the storage portion 36 and the branch pipe 40 may be connected to the outflow pipe 30 or the outflow header 26.

Figure 5:
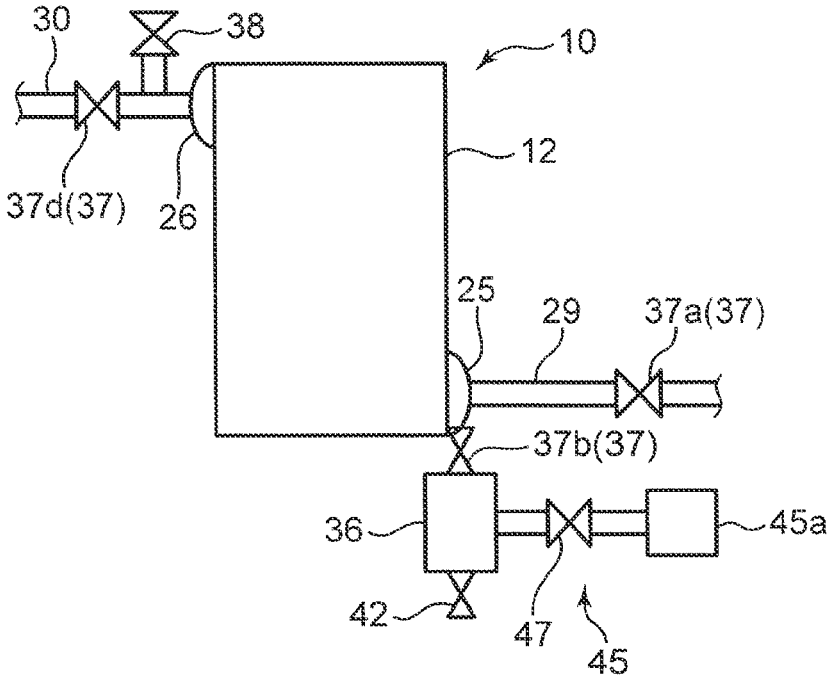
FIG. 5 is a schematic view illustrating a modification of a configuration in which a suction unit is provided.

Although the first embodiment adopts the configuration in which the warming fluid in the warming fluid channel 18 flows down to the branch pipe 40 by gravity, a suction unit 45 for suctioning the warming fluid in the warming fluid channel 18 may be provided as illustrated in FIG. 5. The suction unit 45 includes a vacuum pump 45*a* connected to the storage portion 36 via a pipe, and the pipe is provided with an on-off valve 47. The on-off valve 47 is normally closed, and is opened when the vacuum pump 45*a* is operated. When the warming fluid in the warming fluid channel 18 is sucked by the suction unit 45, the branch pipe 40 is not necessarily connected to the bottom portion of the inflow header 25. Also in the configuration having the suction unit 45 provided, the branch valve 37*b* may be connected to the inflow pipe 29.

In the configuration having the suction unit 45 provided, the outflow pipe 30 is provided with an outflow side mainstream valve 37*d*. The outflow side mainstream valve 37*d* also constitutes the switching mechanism 37 that switches operation between collection operation of collecting warming fluid from the warming fluid channel 18 and non-collection operation of not collecting the warming fluid.

Second Embodiment

Figure 6:
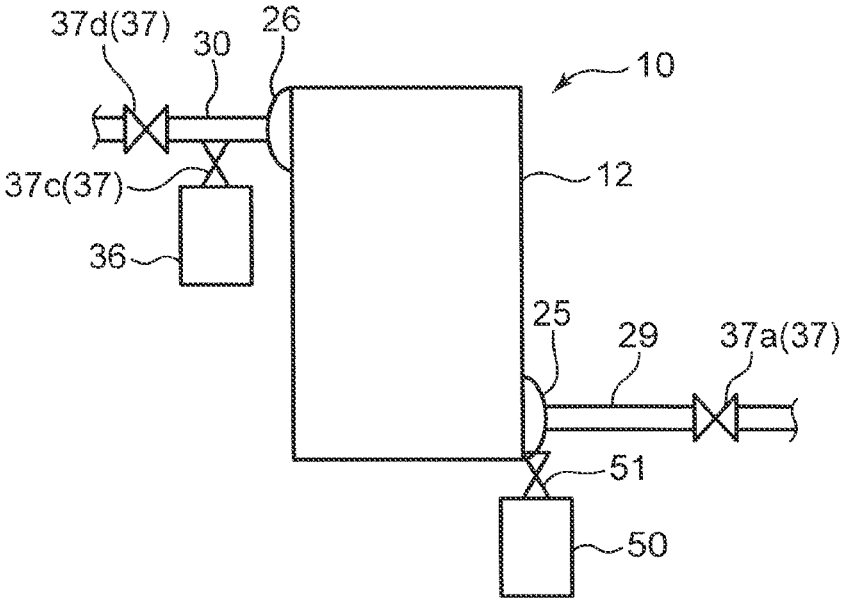
FIG. 6 is a schematic view of a laminated fluid warmer according to a second embodiment.

FIG. 6 illustrates a second embodiment. Here, the same components as those of the first embodiment are denoted by the same reference numerals, and detailed description thereof will be omitted.

In the second embodiment, a gas ejection portion 50 for pushing out gas toward the warming fluid channel 18 is provided. Note that the opening and closing mechanism 38 is omitted.

The gas ejection portion 50 is for causing the warming fluid in the warming fluid channel 18 to flow out from the warming fluid channel 18 by the gas pressure, and is attached to, for example, the inflow header 25 and ejects gas toward the inside of the inflow header 25. An on-off valve 51 is provided between the gas ejection portion 50 and the inflow header 25. The on-off valve 51 is closed during the normal operation and is opened at the time of sending out gas from the gas ejection portion 50.

In the example illustrated in FIG. 6, the gas ejection portion 50 is attached to the first header (the inflow header 25) closer to the distribution header 21 for the warming target fluid out of the two headers (the inflow header 25 and the outflow header 26) communicating with the warming fluid channel 18. In other words, the gas ejection portion 50 introduces gas into the warming fluid channel 18 at a position close to the distribution header 21. Therefore, it is possible to more quickly release, from the position, the warming fluid that exchanges heat with the warming target fluid having a lower temperature immediately after passing through the distribution header 21. Then, the warming fluid extruded from the warming fluid channel 18 is introduced into the outflow header 26 (a second header). Although the gas is, for example, nitrogen gas, the gas is not limited thereto as long as it is not frozen by the warming target fluid.

In a case of the laminated fluid warmer 10 in which the outflow header 26 is closer to the distribution header 21 than the inflow header 25, the gas ejection portion 50 may be attached to the outflow header 26 (a first header). In this case, the storage portion 36 is attached to the inflow header 25 (the second header).

The storage portion 36 receives the warming fluid pushed out from the warming fluid channel 18 by the gas from the gas ejection portion 50. The switching mechanism 37 includes the outflow side mainstream valve 37*d* that opens and closes the outflow pipe 30, and an outflow side branch valve 37*c* provided to branch from the outflow pipe 30 at a position closer to the warming fluid channel 18 than the outflow side mainstream valve 37*d*. The storage portion 36 is connected to the outflow pipe 30 via the outflow side branch valve 37*c*.

The outflow side branch valve 37*c* may be attached to the outflow header 26 instead of being attached to the outflow pipe 30. The outflow side branch valve 37*c* may not be directly attached to the outflow pipe 30, but may be provided at a branch pipe (not illustrated) branching from the outflow pipe 30. In other words, the outflow side branch valve 37*c* and the storage portion 36 may be provided so as to branch from the outflow pipe 30.

During the normal operation, the outflow side mainstream valve 37*d* is opened and the outflow side branch valve 37*c* is closed. Then, when the gas is sent out from the gas ejection portion 50 to collect the warming fluid, the outflow side mainstream valve 37*d* is closed and the outflow side branch valve 37*c* is opened.

Therefore, the second embodiment enables the warming fluid in the warming fluid channel 18 to flow out from the warming fluid channel 18 using the pressure of the gas from the gas ejection portion 50. Therefore, the warming fluid can be collected more quickly as compared with a configuration in which the warming fluid is caused to flow out from the warming fluid channel 18 by gravity.

Although in FIG. 6, the gas ejection portion 50 is attached to the inflow header 25, the present embodiment is not limited thereto. For example, the gas ejection portion 50 may be connected to a branch pipe (not illustrated) that branches from the inflow pipe 29 at a position closer to the inflow header 25 than the mainstream valve 37*a*, or may be attached to the inflow pipe 29 at a position closer to the inflow header 25 than the mainstream valve 37*a*.

Further, the gas ejection portion 50 may be attached to the outflow pipe 30 or the outflow header 26. In this case, the storage portion 36 is attached to the inflow header 25 or the inflow pipe 29.

Although the second embodiment also adopts the configuration in which the collection device 35 includes the storage portion 36, the present embodiment is not limited thereto, and the second embodiment may adopt a configuration in which the collection device 35 does not include the storage portion 36. In this case, the collection device 35 may be configured to have a branch pipe (not illustrated) connected to the outflow pipe 30 or the outflow header 26, and the branch pipe may be configured to receive the warming fluid flowing out from the warning fluid channel 18 at the time of collection of the warming fluid from the warming fluid channel 18. This branch pipe functions as a reception pipe. However, in a case where the gas ejection portion 50 is attached to the outflow pipe 30 or the outflow header 26, the branch pipe is connected to the inflow pipe 29 or the inflow header 25.

Although descriptions of other configurations, operations, and effects are omitted, the description of the first embodiment can be applied to the second embodiment.

Third Embodiment

Figure 7:
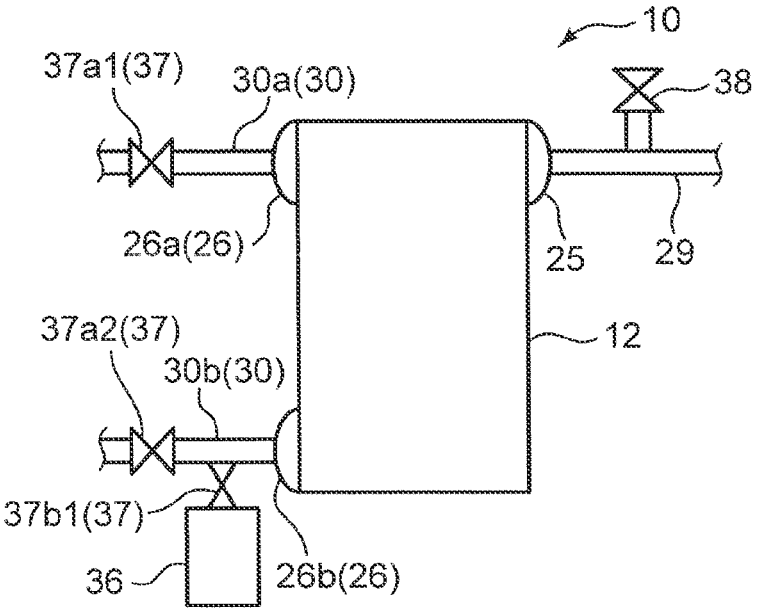
FIG. 7 is a schematic view of a laminated fluid warmer according to a third embodiment.
Figure 8:
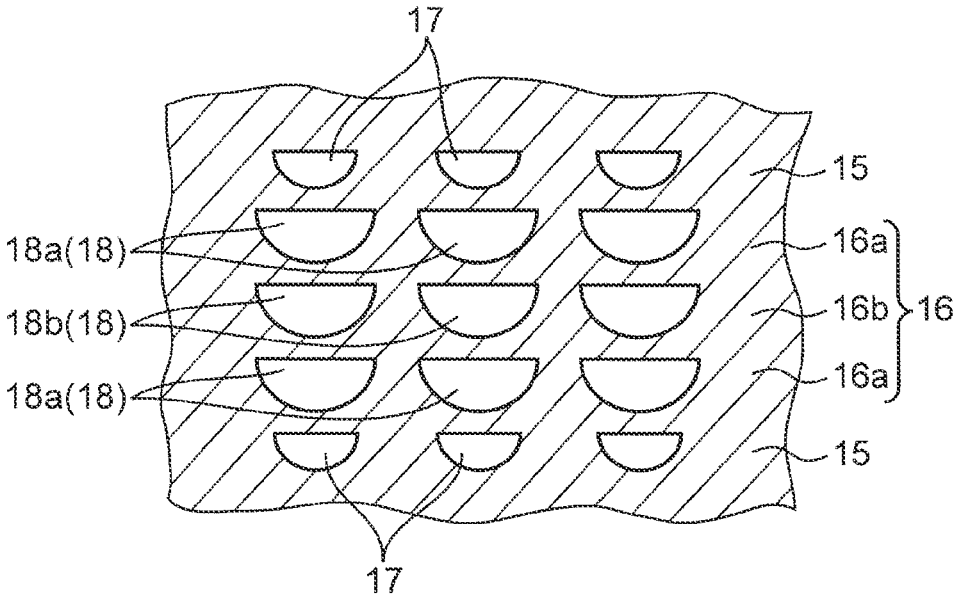
FIG. 8 is an enlarged view illustrating a partial cross-sectional configuration of a laminate of the laminated fluid warmer according to the third embodiment.

FIG. 7 and FIG. 8 illustrate a third embodiment. Here, the same components as those of the first embodiment are denoted by the same reference numerals, and detailed description thereof will be omitted.

In the third embodiment, as illustrated in FIG. 8, the warming fluid layer 16 includes a first warming fluid layer 16*a* and a second warming fluid layer 16*b*. The first warming fluid layer 16*a* is a layer adjacent to the target fluid layer 15, and the second warming fluid layer 16*b* is a layer adjacent to the first warming fluid layer 16*a*. Since another first warming fluid layer 16*a* is adjacent to the second warming fluid layer 16*b*, the target fluid layer 15 is not adjacent to the second warming fluid layer. In other words, the second warming fluid layer 16*b* is sandwiched between the two first warming fluid layers 16*a*. Another target fluid layer 15 is adjacent to the another first warming fluid layer 16*a*.

The warming fluid flows into each of a plurality of first warming fluid channels 18*a* provided in the first warming fluid layer 16*a* and a plurality of second warming fluid channels 18*b* provided in the second warming fluid layer 16*b*, and exchanges heat with the warming target fluid flowing through the plurality of target fluid channels 17 of the target fluid layer 15. At this time, the warming fluid flowing through the first warming fluid channel 18*a* is cooled more than the warming fluid flowing through the second warming fluid channel 18*b*.

The warming fluid in the inflow header 25 is distributed to the first warming fluid channel 18*a* and the second warming fluid channel 18*b*. On the other hand, as illustrated in FIG. 7, the outflow header 26 includes a first outflow header 26*a* and a second outflow header 26*b*. A space in the first outflow header 26*a* communicates with the first warming fluid channel 18*a*, and a space in the second outflow header 26*b* communicates with the second warming fluid channel 18*b*. Accordingly, the warming fluid flowing through the first warming fluid channel 18*a* flows into the first outflow header 26*a*, and the warming fluid flowing through the second warming fluid channel 18*b* flows into the second outflow header 26*b*.

The outflow pipe 30 includes a first outflow pipe 30*a* connected to the first outflow header 26*a* and a second outflow pipe 30*b* connected to the second outflow header 26*b*. Accordingly, the warming fluid in the first outflow header 26*a* flows into the first outflow pipe 30*a*, while the warming fluid in the second outflow header 26*b* flows into the second outflow pipe 30*b*.

The switching mechanism 37 includes a first mainstream valve 37*a*1 provided at the first outflow pipe 30*a*, a second mainstream valve 37*a*2 provided at the second outflow pipe 30*b*, and a branch valve 37*b*1 provided so as to branch from the second outflow pipe 30*b* at a position closer to the warming fluid channel 18 than the second mainstream valve 37*a*2. The branch valve 37*b*1 may be provided at the second outflow header 26*b*.

Although the opening and closing mechanism 38 is provided at the inflow pipe 29, it may be provided at the inflow header 25 instead.

The storage portion 36 is connected to the second outflow pipe 30*b* via the branch valve 37*b*1. Therefore, when the second mainstream valve 37*a*2 is closed and the opening and closing mechanism 38 and the branch valve 37*b*1 are opened, the warming fluid in the second warming fluid channel 18*b* is collected into the storage portion 36 through the second outflow header 26*b* and the second outflow pipe 30*b*. At this time, the warming fluid in the first warming fluid channel 18*a* is not collected in the storage portion 36.

In the third embodiment, the collection device 35 selectively collects the wanting fluid from the first warning fluid channel 18*a* and the second warning fluid channel 18*b*. Therefore, while the warming capacity of the warming target fluid can be enhanced by the first warming fluid layer 16*a* and the second warming fluid layer 16*b*, the outflow amount of the warming fluid caused to flow out from the plurality of warming fluid channels 18 can be reduced.

In the third embodiment, the second warming fluid layer 16*b* is sandwiched between the two first warming fluid layers 16*a*. Since in this configuration, the warming fluid in the second warming fluid channel 18*b* is less likely to be cooled than the warming fluid in the first warming fluid channel 18*a*, the warming fluid in the second warming fluid channel 18*b* can be easily collected. Furthermore, even if the warming fluid in the first warming fluid channel 18*a* is frozen in a state where the flow of the warming fluid in the first warming fluid channel 18*a* is stopped, the warming fluid in the first warming fluid channel 18*a* can be melted by causing the warming fluid to flow into the second warming fluid channel 18*b*.

Although in the third embodiment, the collection device 35 is configured to selectively collect the warming fluid from the second warming fluid channel 18*b*, the present embodiment is not limited thereto. The collection device 35 may be configured to selectively collect the warming fluid from the first warming fluid channel 18*a*. Specifically, since the warming fluid in the first warming fluid channel 18*a* is more likely to be frozen than the warming fluid in the second warming fluid channel 18*b*, it is easy to avoid freezing of the warming fluid if the warming fluid is selectively collected from the first warming fluid channel 18*a*.

Although the third embodiment adopts the configuration in which the warming fluid is divided from the inflow header 25 into the first warming fluid channel 18*a* and the second warming fluid channel 18*b*, the present embodiment is not limited thereto. For example, the inflow header 25 may have a first inflow header and a second inflow header, and the inflow pipe 29 may have a first inflow pipe connected to the first inflow header and a second inflow pipe connected to the second inflow header. In this case, the warming fluid in the first inflow pipe flows into the first warming fluid channel 18*a* through the first inflow header, and the warming fluid in the second inflow pipe flows into the second war ruing fluid channel 18*b* through the second inflow header. In this case, the storage portion 36 or the branch pipe 40 that collects the warming fluid from the second warming fluid channel 18*b* may be connected to the second inflow header or the second inflow pipe.

The third embodiment also may adopt a configuration in which the warming fluid is collected using the suction unit 45 or the gas ejection portion 50, not limited to the configuration in which the warming fluid is collected by gravity.

Although descriptions of other configurations, operations, and effects are omitted, the descriptions of the first and second embodiments can be applied to the third embodiment.

Fourth Embodiment

Figure 9A:
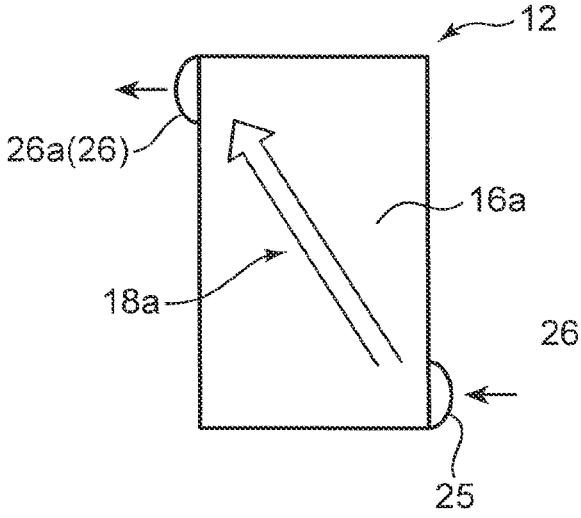
FIG. 9A is a diagram for explaining a range in which a first warming fluid channel is provided in a laminated fluid warmer according to a fourth embodiment.
Figure 9B:
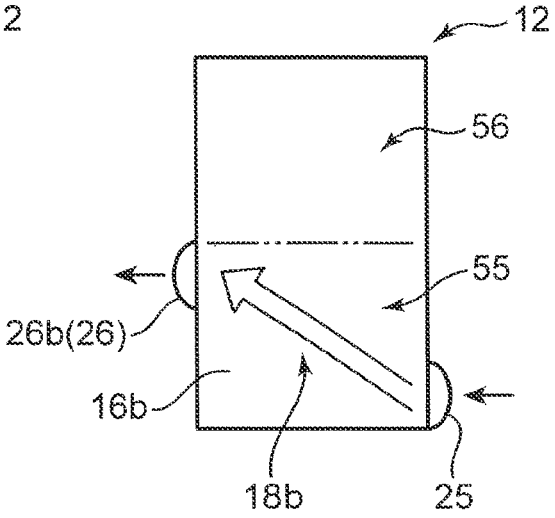
FIG. 9B is a diagram for explaining a range in which a second warming fluid channel is provided in the laminated fluid warmer according to the fourth embodiment.

FIG. 9A and FIG. 9B illustrate a fourth embodiment. Here, the same components as those of the first embodiment are denoted by the same reference numerals, and detailed description thereof will be omitted.

In the fourth embodiment, a size of a region where the second warming fluid channel 18*b* is provided in the second warming fluid layer 16*b* and a size of a region where the first warming fluid channel 18*a* is provided in the first warming fluid layer 16*a* are different from each other.

Specifically, the plurality of first warming fluid channels 18*a* is provided in a range over the entire first warming fluid layer 16*a* (the laminate 12). Therefore, as illustrated in FIG. 9A, the inflow header 25 is located at a lower end portion of the laminate 12, while the first outflow header 26*a* is located at an upper end portion of the laminate 12. Therefore, the plurality of first warming fluid channels 18*a* is provided in a region from the lower end portion to the upper end portion of the laminate 12.

By contrast, as illustrated in FIG. 9B, the second outflow header 26*b* is located at a height of an intermediate portion of the laminate 12. Therefore, the plurality of second warming fluid channels 18*b* is provided in a region 55 from the lower end portion to the intermediate portion of the laminate 12, but is not provided in a region 56 from the intermediate portion to the upper end portion of the laminate 12. In other words, the second warming fluid channel 18*b* is formed only in a range from a position corresponding to an inlet of the first warming fluid channel 18*a* to a position corresponding to an intermediate portion of the first warming fluid channel 18*a*. In this case, since the second warming fluid layer 16*b* can be configured by the second metal plate having the groove forming the second warming fluid channel 18*b* and the metal plate having no groove, even when a manufacturing method of etching the second metal plate is adopted, manufacturing costs of the laminate 12 can be reduced.

In this configuration, the collection device 35 selectively collects the warming fluid in the first warming fluid channel 18*a* or the warming fluid in the second warming fluid channel 18*b*. In particular, if the collection device 35 is configured to collect the warming fluid in the second warming fluid channel 18*b*, the amount of the warming fluid collected by the collection device 35 can be reduced.

Although descriptions of other configurations, operations, and effects are omitted, the descriptions of the first to third embodiments can be applied to the fourth embodiment.

Other Embodiments

It should be understood that the embodiments disclosed herein are illustrative in all respects and are not restrictive. The present invention is not limited to the above embodiments, and various modifications, improvements, and the like can be made without departing from the gist of the present invention. For example, although in each embodiment, the laminated fluid warmer 10 is formed as a warmer by which a warming target fluid is warmed so as to vaporize, the present embodiment is not limited thereto. For example, the laminated fluid warmer 10 may be configured such that a warming target fluid is warmed within a range equal to or lower than a temperature at which the warming target fluid vaporizes.

Here, the embodiments will be outlined.

(1) The laminated fluid warmer according to the embodiment includes: a laminate including a target fluid layer having a plurality of target fluid channels for flowing a warming target fluid, and a warming fluid layer that is laminated on the target fluid layer and has a plurality of warming fluid channels for flowing a warming fluid for warming the target fluid layer; and a collection device for collecting at least a part of the warming fluid accumulated in the plurality of warming fluid channels.

In the laminated fluid warmer, the collection device collects at least a part of the warming fluid accumulated in the plurality of warming fluid channels of the warming fluid layer. Therefore, since it is possible to prevent a state where the warming fluid is accumulated in the warming fluid channel from being maintained, it is possible to prevent the warming fluid from being cooled more than necessary by the warming target fluid even in a state where the flow of the warming fluid is stopped. Therefore, it is possible to prevent the warming fluid from freezing in the warming fluid channel. In particular, in a case where the warming fluid channel formed in the warming fluid layer is formed of a small-diameter channel, the warming fluid might freeze early when the warming fluid does not flow in the warming fluid channel. However, collecting the warming fluid by the collection device avoids freezing of the warming fluid in the warming fluid channel.

(2) The collection device may include a reception pipe or a storage portion for receiving the warming fluid flowing out from the plurality of warming fluid channels when collecting the warming fluid from the plurality of warming fluid channels. In this mode, the warming fluid flowing out from the warming fluid channel is collected in the reception pipe or the storage portion.

(3) The reception pipe or the storage portion may be connected to a header communicating with the plurality of warming fluid channels, or connected to an inflow pipe or an outflow pipe connected to the header.

In this mode, the warming fluid flowing out from the warming fluid channel is collected in the reception pipe or the storage portion through the header, or collected in the reception pipe or the storage portion through the header and the inflow pipe or the outflow pipe. Among these cases, in a case where the reception pipe or the storage portion is connected to the header, when this connection portion is at a position lower than the warming fluid channel, more warming fluid can be collected through the header. In a case where the reception pipe or the storage portion is connected to the header, when this connection portion is at a position higher than the inflow pipe or the outflow pipe, the warming fluid in the inflow pipe and the outflow pipe does not flow into the reception pipe or the storage portion, so that the reception pipe or the storage portion can be downsized. In a case where the reception pipe or the storage portion is connected to the inflow pipe or the outflow pipe, since the warming fluid in the warming fluid channel located above the inflow pipe or the outflow pipe can be collected, a large amount of warming fluid can be collected through the inflow pipe or the outflow pipe.

(4) The collection device may include a gas ejection portion for pushing out a gas, and a reception pipe or a storage portion for receiving the warming fluid pushed out from the plurality of warming fluid channels by the gas from the gas ejection portion.

In this mode, the pressure of the gas from the gas ejection portion is used to cause the warming fluid in the warming fluid channel to flow out from the warming fluid channel. Therefore, the warming fluid can be collected more quickly as compared with the configuration in which the warming fluid is caused to flow out by gravity.

(5) The gas ejection portion may be connected to a header communicating with the plurality of warming fluid channels, or connected to an inflow pipe or an outflow pipe connected to the header.

In this mode, the gas ejection portion causes the gas to flow toward the warming fluid in the header or the warming fluid in the inflow pipe or the outflow pipe. Upon receiving the gas pressure at this time, the warming fluid in the warming fluid channel is pushed out from the warming fluid channel and collected in the reception pipe or the storage portion.

(6) The gas ejection portion may be connected to a first header located at a side closer to an inlet of the plurality of target fluid channels among a plurality of headers communicating with the plurality of warming fluid channels, or connected to an inflow pipe or an outflow pipe connected to the first header. In this case, the reception pipe or the storage portion may be connected to a second header communicating with the first header through the plurality of warming fluid channels among the plurality of headers, or connected to an inflow pipe or an outflow pipe connected to the second header.

In this mode, the gas ejection portion is connected to the first header located at the side closer to the inlet of the target fluid channel, or connected to the inflow pipe or the outflow pipe connected to the first header. Therefore, the gas from the gas ejection portion reaches a position corresponding to the inlet of the target fluid channel earlier. Therefore, the warming fluid can be released more quickly from the position, in the warming fluid channel, corresponding to the inlet of the target fluid channel that tends to have a lower temperature.

(7) The warming fluid layer may include a first warming fluid layer adjacent to the target fluid layer and a second warming fluid layer adjacent to the first warming fluid layer without being adjacent to the target fluid layer. The plurality of warming fluid channels may include a plurality of first warming fluid channels formed in the first warming fluid layer and a plurality of second warming fluid channels formed in the second warming fluid layer. In this case, the collection device may selectively collect the warming fluid from the plurality of first warming fluid channels and the plurality of second warming fluid channels.

In this mode, while the warming ability of the warming target fluid can be enhanced by the first warming fluid layer and the second warming fluid layer, an outflow amount of the warming fluid caused to flow out from the plurality of warming fluid channels can be reduced.

(8) The warming fluid layer may include two first warming fluid layers including the first warming fluid layer. In this case, the second warming fluid layer may be sandwiched between the two first warming fluid layers.

In this mode, since the warming fluid in the second warming fluid channel is less likely to be frozen than the warming fluid in the first warming fluid channel, the warming fluid in the second warming fluid channel can be easily collected. On the other hand, since the warming fluid in the first warming fluid channel is more likely to be frozen than the warming fluid in the second warming fluid channel, it is easy to avoid freezing of the warming fluid by selectively collecting the warming fluid in the first warming fluid channel.

(9) The plurality of second warming fluid channels may be formed only in a range from a position corresponding to an inlet of the plurality of first warming fluid channels to a position corresponding to an intermediate portion of the plurality of first warming fluid channels in the second warming fluid layer.

In this mode, in the second warming fluid layer, the second warming fluid channel is not formed in a range from the position corresponding to the intermediate portion of the first warming fluid channel to a position corresponding to an outlet of the first warming fluid channel. In other words, there is a case where the warming target fluid can be warmed to a desired temperature without providing the second warming fluid channel on the outlet side of the first warming fluid channel that will have a higher temperature. In this case, labor required for forming the second warming fluid channel can be reduced by not forming the second warming fluid channel in the above range. In addition, the amount of the warming fluid collected from the second warming fluid channel can be reduced.

(10) The plurality of warming fluid channels may have a structure in which the warming fluid in the plurality of warming fluid channels flows by gravity and flows out from the plurality of warming fluid channels at the time of collection of the warming fluid by the collection device.

In this mode, the warming fluid in the warming fluid channel can be collected without providing a pressurizing unit for pushing out the warming fluid in the warming fluid channel or a suction portion for sucking the warming fluid in the warming fluid channel.

As described above, even when the flow of the warming fluid is stopped, freezing of the warming fluid can be suppressed.

This application is based on Japanese Patent Application No. 2020-218727 filed on Dec. 28, 2020, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A laminated fluid warmer comprising:

a laminate including a target fluid layer having a plurality of target fluid channels for flowing a warming target fluid, and a warming fluid layer that is laminated on the target fluid layer and has a plurality of warming fluid channels for flowing a warming fluid for warming the target fluid layer; and a collection device for collecting at least a part of the warming fluid accumulated in the plurality of warming fluid channels, wherein the warming fluid layer includes a first warming fluid layer adjacent to the target fluid layer and a second warming fluid layer adjacent to the first warming fluid layer without being adjacent to the target fluid layer, the plurality of warming fluid channels includes a plurality of first warming fluid channels formed in the first warming fluid layer and a plurality of second warming fluid channels formed in the second warming fluid layer, and the collection device selectively collects the warming fluid from the plurality of first warming fluid channels and the plurality of second warming fluid channels.

2. The laminated fluid warmer according to claim 1, wherein the warming fluid layer includes two first warming fluid layers including the first warming fluid layer, and the second warming fluid layer is sandwiched between the two first warming fluid layers.

3. The laminated fluid warmer according to claim 1, wherein the plurality of second warming fluid channels is formed only in a range from a position corresponding to an inlet of the plurality of first warming fluid channels to a position corresponding to an intermediate portion of the plurality of first warming fluid channels in the second warming fluid layer.

4. The laminated fluid warmer according to claim 1, wherein the plurality of warming fluid channels has a structure in which the warming fluid in the plurality of warming fluid channels flows by gravity and flows out from the plurality of warming fluid channels at the time of collection of the warming fluid by the collection device.

5. The laminated fluid warmer according to claim 1, wherein the collection device includes a gas ejection portion for pushing out a gas, and a reception pipe or a storage portion for receiving the warming fluid pushed out from the plurality of warming fluid channels by the gas from the gas ejection portion.

6. The laminated fluid warmer according to claim 5, wherein the gas ejection portion is connected to a header communicating with the plurality of warming fluid channels, or connected to an inflow pipe or an outflow pipe connected to the header.

7. A laminated fluid warmer comprising:

a laminate including a target fluid layer having a plurality of target fluid channels for flowing a warming target fluid, and a warming fluid layer that is laminated on the target fluid layer and has a plurality of warming fluid channels for flowing a warming fluid for warming the target fluid layer; and a collection device for collecting at least a part of the warming fluid accumulated in the plurality of warming fluid channels, wherein the collection device includes a gas ejection portion for pushing out a gas, and a reception pipe or a storage portion for receiving the warming fluid pushed out from the plurality of warming fluid channels by the gas from the gas ejection portion, the gas ejection portion is connected to a first header located at a side closer to an inlet of the plurality of target fluid channels among a plurality of headers communicating with the plurality of warming fluid channels, or connected to an inflow pipe or an outflow pipe connected to the first header, and the reception pipe or the storage portion is connected to a second header communicating with the first header through the plurality of warming fluid channels among the plurality of headers, or connected to an inflow pipe or an outflow pipe connected to the second header.

* * * * *